United States Patent [19]

Weiser

[11] 4,068,403

[45] Jan. 17, 1978

[54] FINGER OPERATED MAGICIAN SIMULATING ANIMATED TOY

[75] Inventor: Hal Weiser, New York, N.Y.

[73] Assignee: Durham Industries, Inc., New York, N.Y.

[21] Appl. No.: 741,189

[22] Filed: Nov. 12, 1976

[51] Int. Cl.[2] ..... A63H 33/26; A63H 11/00

[52] U.S. Cl. ..... 46/241; 46/118; 46/119; 46/120; 40/419; 273/145 R

[58] Field of Search ..... 46/41, 91, 118–120, 46/121, 126, 241; 40/106.35; 273/145 R

[56] References Cited

U.S. PATENT DOCUMENTS

| | | | |
|---|---|---|---|
| 1,020,896 | 3/1912 | Fisher | 40/106.35 |
| 1,187,113 | 6/1913 | Truetzschler | 40/106.35 |
| 1,480,524 | 1/1924 | Garlick | 40/106.35 |
| 2,763,959 | 9/1956 | Glass et al. | 46/118 |
| 2,975,533 | 3/1961 | Burns, Jr. | 46/119 |
| 3,564,763 | 2/1971 | Cleveland et al. | 46/120 |
| 3,684,291 | 8/1972 | Johmann | 273/145 R |
| 3,731,427 | 5/1973 | Lewis et al. | 46/239 |
| 3,888,023 | 6/1975 | Genin | 46/120 |
| 3,964,205 | 6/1976 | Kuramochi | 46/120 |
| 3,998,001 | 12/1976 | Meyer et al. | 46/41 |

*Primary Examiner*—Louis G. Mancene
*Assistant Examiner*—Robert F. Cutting
*Attorney, Agent, or Firm*—Wolder & Gross

[57] ABSTRACT

An animated toy includes a hollow base which supports a hollow upright animal figure communicating with the base and having a pair of swingable arms. A housing communicates with and is located on the base in front of the figure and has a top slot through which housing located panels are vertically slidable and on which a compartment member carrying receptacle is separably coupled. A plurality of levers are housed in the base and have exposed buttons. A lever is coupled to each arm and a lever is coupled to each panel to individually swing the arms and raise and lower the panels. One of the arms carries a magnet for lifting magnetic pieces from the compartment member as well as retaining a cover cloth by a metal bar secured within a fold of the cloth to hide from view the movement of the panels. A water reservoir and lever operated pump are housed in the base, the pump outlet being connected to a nozzle on the figure. A retractable wand is carried by one of the figure arms.

13 Claims, 30 Drawing Figures

FINGER OPERATED MAGICIAN SIMULATING ANIMATED TOY

BACKGROUND OF THE INVENTION

The present invention relates generally to improvements in toys and it relates more particularly to an improved finger manipulated multi-functional animated toy.

There are many forms of animated toys which are available and these are generally of two types, those which are motor driven by either electric or mechanical motors and those which are manually driven by various mechanical arrangements. The present invention relates to animated toys of the latter type in which various of the toy movements and functions may be separately and independently effected and controlled. A great variety of toys have been heretofore available in which the toy functions and movements are manually effected, but these possess numerous drawbacks and disadvantages. They are complex and unreliable devices of very limited ranges of performance, difficult to manipulate and operate, of little versatility and adaptability and otherwise leave much to be desired.

SUMMARY OF THE INVENTION

It is a principal object of the present invention to provide an improved toy.

Another object of the present invention is to provide an improved animated toy.

Still another object of the present invention is to provide an improved multifunctional hand manipulated and motivated animated toy.

A further object of the present invention is to provide an improved hand manipulated animated toy functioning to perform magical acts.

Another object of the present invention is to provide a device of the above nature characterized by its reliability, ruggedness, simplicity, wide choice of functions, ease and simplicity of operation, attractive appearance and performance and great versatility and adaptability.

The above and other objects of the present invention will become apparent from a reading of the following description taken in conjunction with the accompanying drawings which illustrate a preferred embodiment thereof.

In a sense the present invention contemplates the provision of an improved toy device comprising an animal figure simulating upright body member including a first arm member supported for swinging between a raised position and a lowered forwardly downwardly extending position, manually operable first actuating means for swinging the first arm member between its raised and lowered positions, a permanent magnet carried by the first arm member proximate its outer end, an article at least partially formed of a magnetic material and means for removably supporting the article proximate the magnet when the first arm is in its lowered position.

According to the preferred embodiment of the present invention the figure is hollow and includes a pair of opposite swingable supported arms and is mounted on and communicates with a hollow base. A plurality of levers are located in the base and project through the rear wall thereof and terminate in actuating keys. A first pair of the levers are coupled by connecting rods to respective arm members to individually motivate the raising and lowering thereof. An open bottomed box is located atop and communicates with the base and is disposed forward of the figure and has a top opening through which selected display panels are slidable to raised positions. Second levers located in the base and projecting rearwardly thereof are drive coupled to the panels and individually control the raising and lowering thereof. A multi-compartment open topped receptacle is separably mounted atop the housing and each contains a magnetic article or panel, the compartment being selectively movable into registry with an access opening in a stationary top wall, the opening registering with the depressed magnet. Another lever operates a positive displacement diaphragm or bellows pump which pumps water from a reservoir to a nozzle located on the upper part of the figure.

The improved animated toy is highly attractive in appearance and operation, highly versatile and adaptable, rugged, reliable and easy and convenient to operate.

DESCRIPTION OF THE PREFERRED EMBODIMENT

Figure 2:
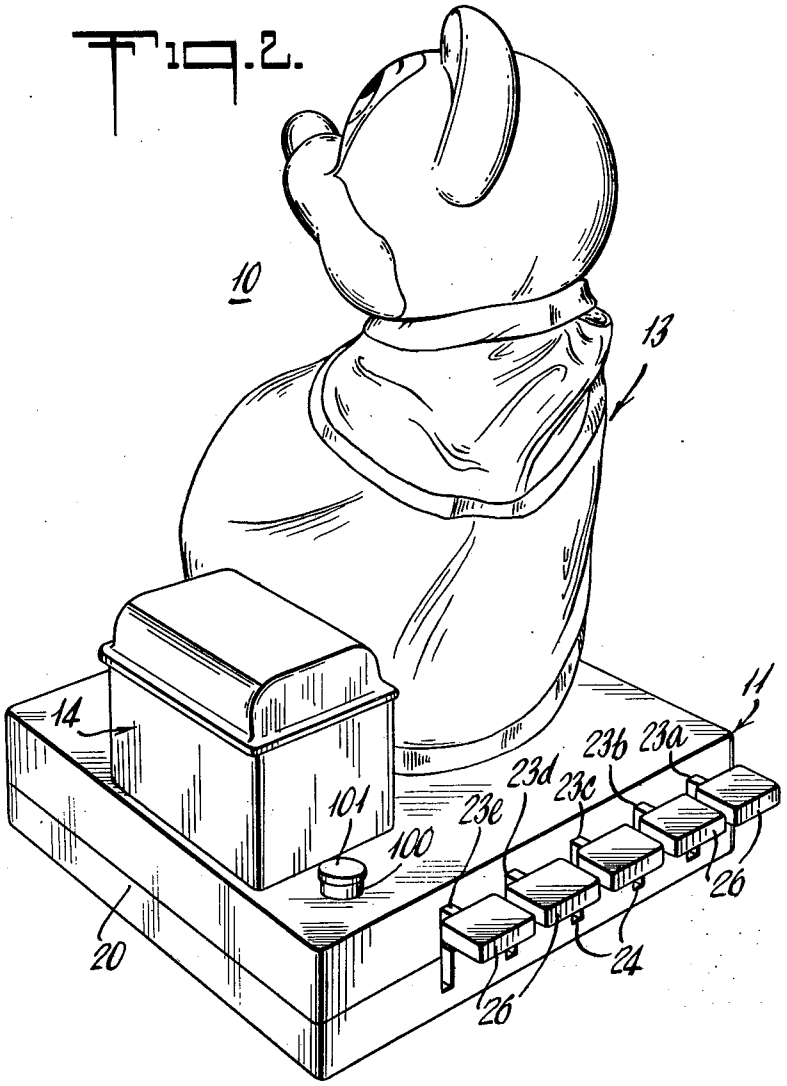
FIG. 2 is a rear perspective view thereof.
Figure 1:
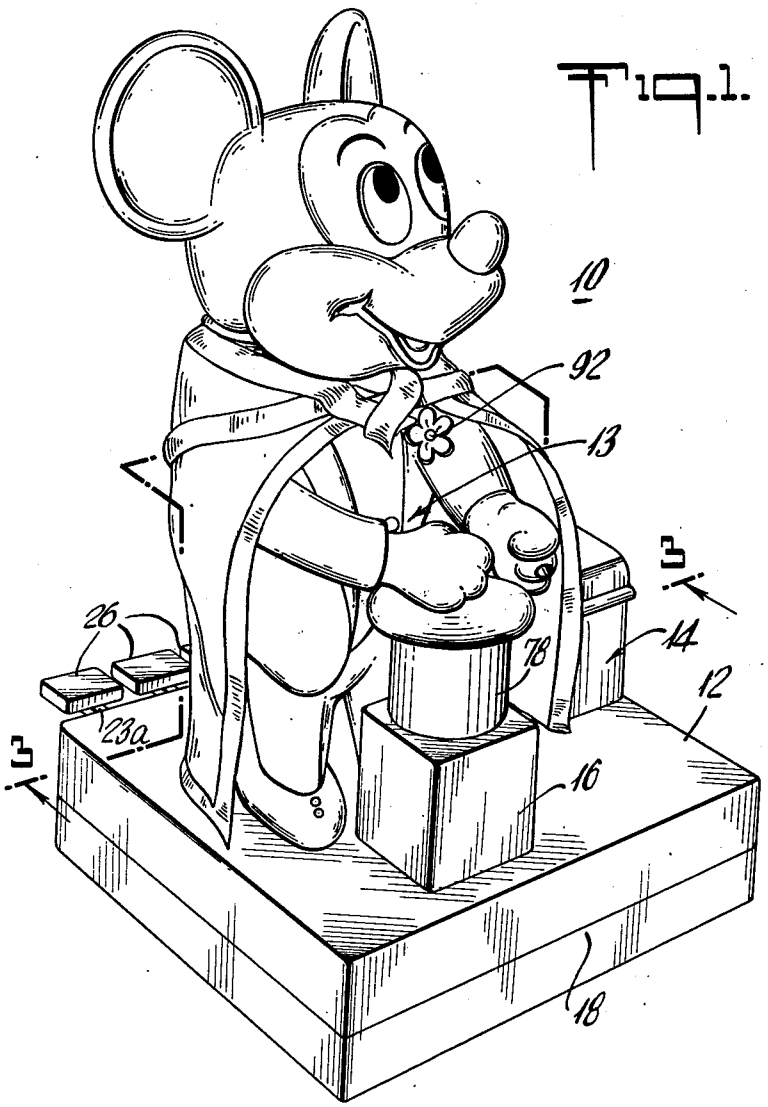
FIG. 1 is a front perspective view of an improved toy embodying the present invention and shown in a rest position.
Figure 3:
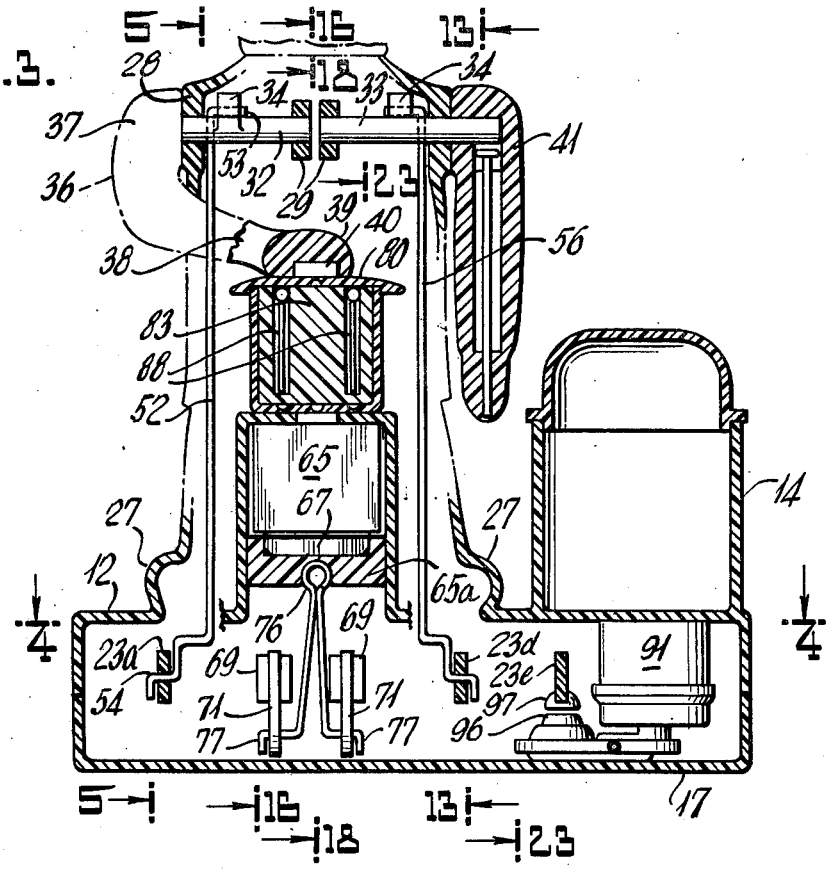
FIG. 3 is a sectional view taken along line 3—3 of FIG. 1.
Figure 4:
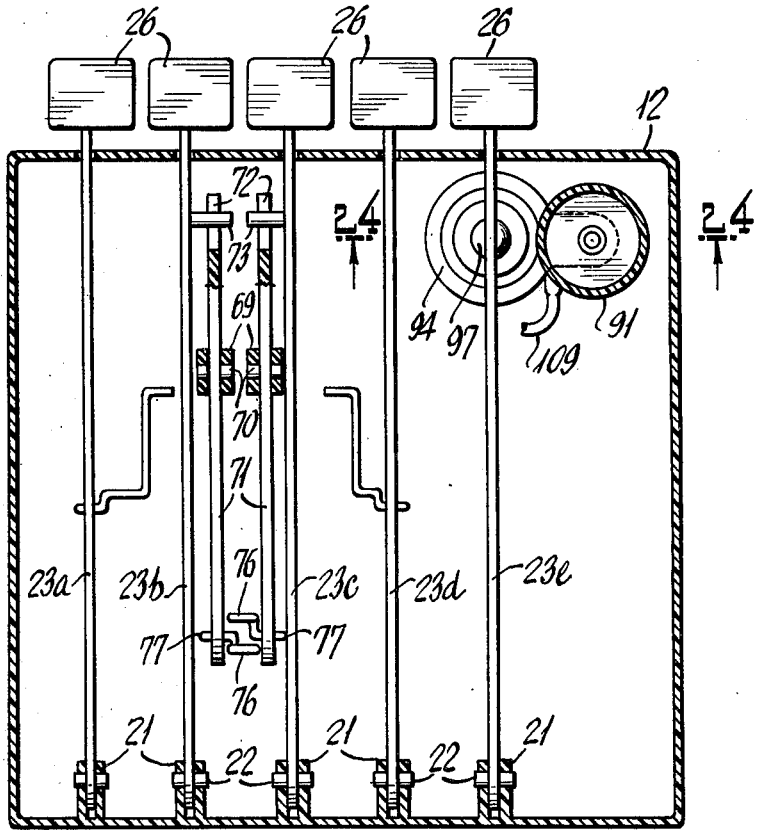
FIG. 4 is a sectional view taken along line 4—4 of FIG. 3.

Referring now to the drawings, particularly FIGS. 1 to 25 thereof, which illustrate a preferred embodiment of the present invention, the reference numeral 10 generally designates the improved animated toy which may be fabricated in any suitable manner and whose components are formed of suitable materials such as metals and plastics, the toy being decorated as desired. The toy 10 includes a shallow box or hollow base portion 11 on the flat top wall 12 of which is positioned a magician mouse simulating FIG. 13, a storage case 14 disposed along a rear side of FIG. 13 and a table simulating box 16 at the front of FIG. 13. The FIG. 13 is decorated as desired and while shown as a mouse, it may be of any desired shape and simulate any animal.

The hollow base 11 is formed of intercoupled top and bottom sections to facilitate construction and includes the flat square top wall 12, a similarly shaped bottom wall 17 and a interconnecting rectangular vertical front wall 18, rear wall 19 and side walls 20. Integrally formed with the rear face of front wall 18 are five transversely spaced rearwardly directed hinge brackets 21 each including a pair of spaced bracket arms supporting between them a corresponding transverse pivot pin 22. Extending rearwardly from each of the pivot pins 22 and supported thereby for swinging about a horizontal transverse axis is a manipulating lever 23 which is individually designated as 23*a*, 23*b*, 23*c*, 23*d* and 23*e*. The levers 23 are formed of metal strips and each projects through and vertically freely slidably engages a corresponding vertical slot 24 formed in base rear wall 19 to permit the rocking of each lever 23 a limited angle, the rear of each lever 23 terminating at its rear externally of rear wall 19 in an upwardly facing finger key or button 26 and being resiliently biased to a raised position by a helical compression spring 25 entrapped between bottom wall 17 and a respective lever 23.

Figures 13, 14, 15:
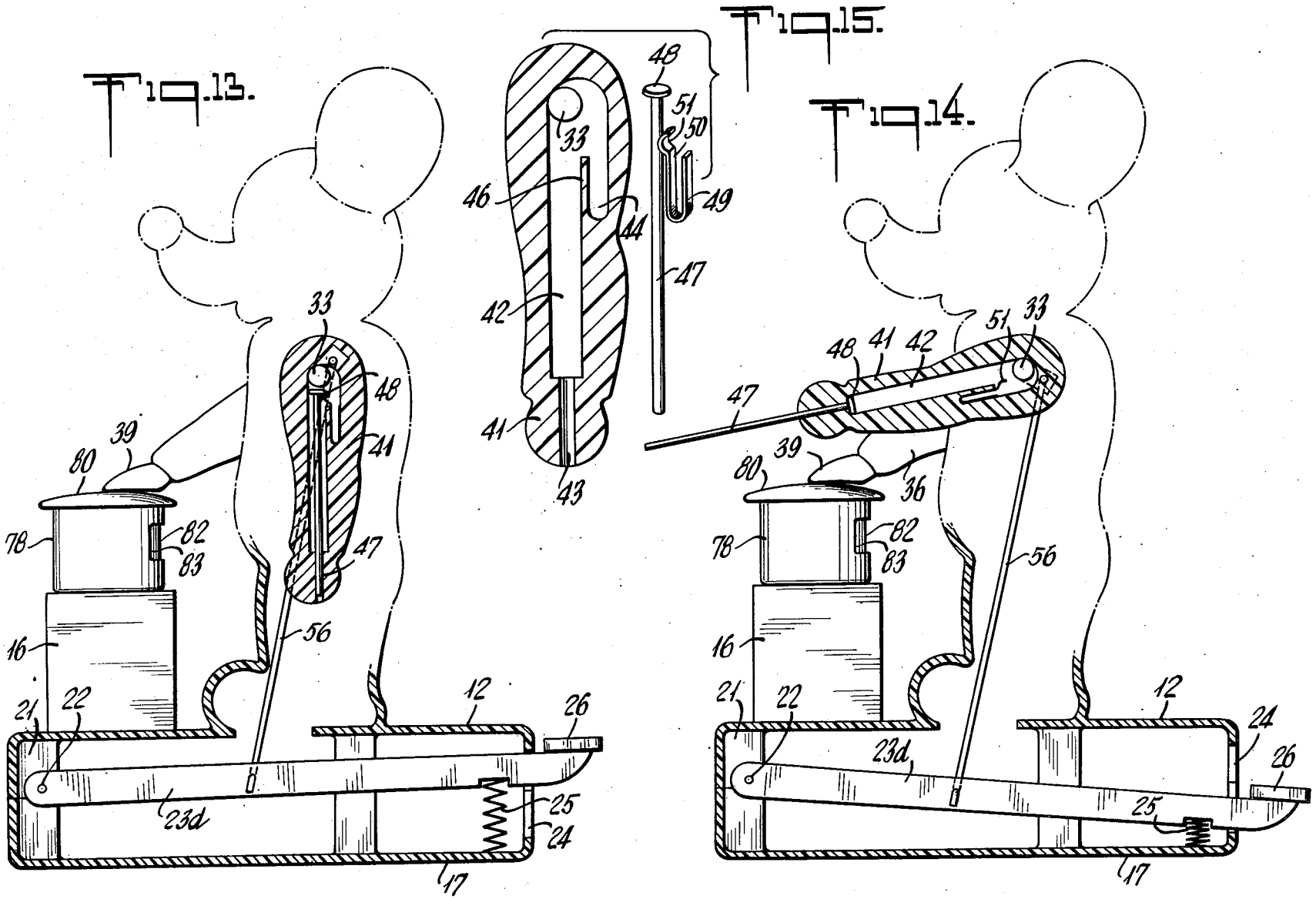
FIG. 13 is a sectional view taken along line 13—13 in FIG. 3.
FIG. 14 is a view similar to FIG. 13 but showing the left arm in raised position.
FIG. 15 is an exploded perspective and sectional view of the toy figure left arm.
Figure 19:
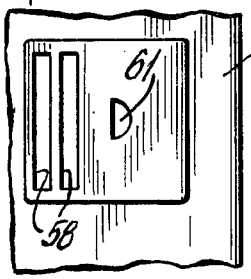
FIG. 19 is a sectional view taken along line 19—19 in FIG. 16.

The FIG. 13 is hollow and includes open bottom foot members 27 joining base top wall 12 and affording communication between the interior of base 11 and the upper part of the figure. The FIG. 13 includes directly below the upper or shoulder portion a pair of vertical transverse parallel plate sections 28 having flat vertical outside faces and transversely aligned bearing defining bores which are transversely axially aligned with bores formed in a pair of transversely spaced bearing bracket arms 29 projecting forwardly from the rear inside face of FIG. 13. First and second transverse shafts 32 and 33 are each journalled in the bores of a plate 28 and the proximate bracket arm 19 and projects outwardly of the corresponding plate 28 and has integrally formed therewith in vertical alignment with an underlying foot opening, a rearwardly upwardly inclined short crank arm 34 having an eccentric link pin bore.

Figure 16:
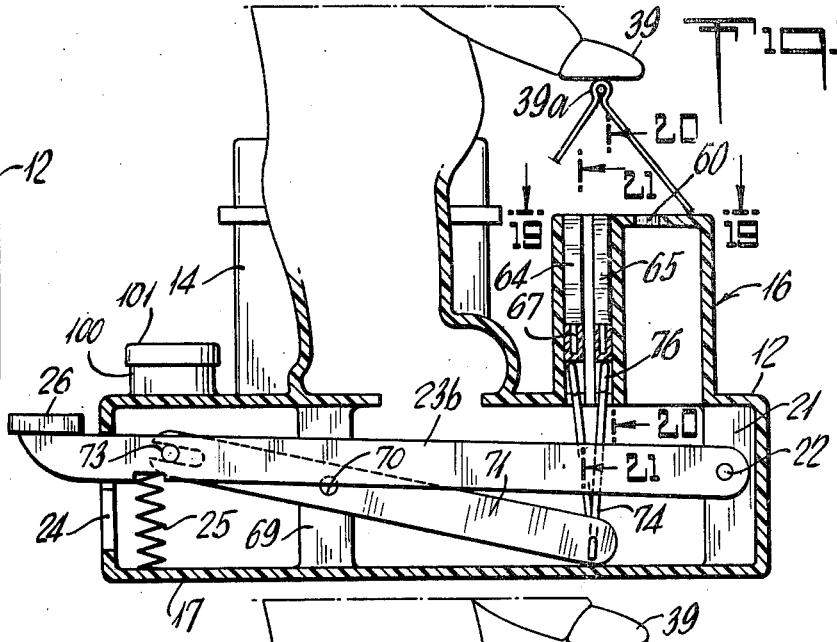
FIG. 16 is a sectional view taken along line 16—16 in FIG. 3.
Figure 17:
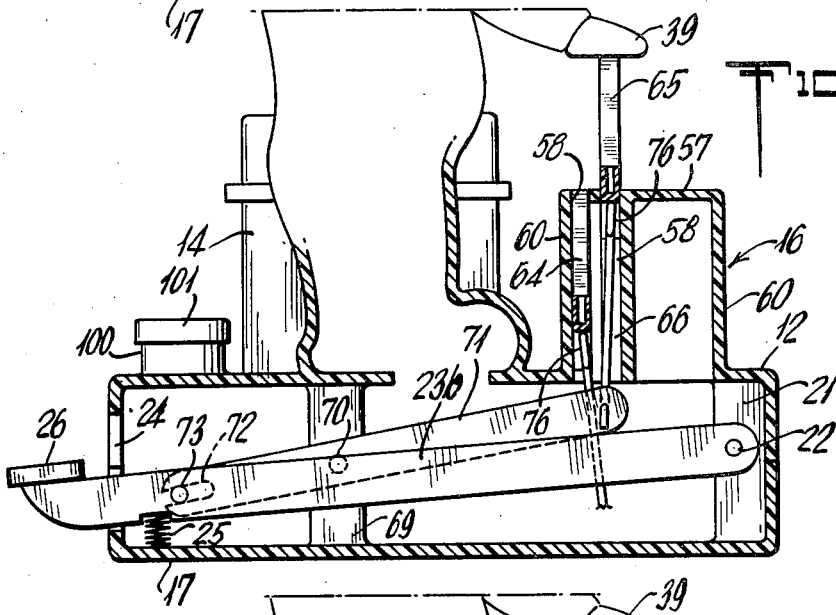
FIG. 17 is a view similar to FIG. 16 but showing a display panel in raised position.
Figure 20:
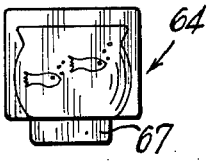
FIG. 20 is a sectional view taken along line 20—20 in FIG. 16.
Figure 21:
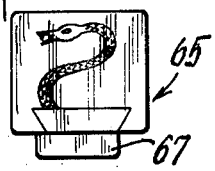
FIG. 21 is a sectional view taken along line 21—21 in FIG. 16.
Figure 22:
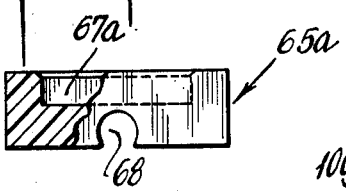
FIG. 22 is a front elevational view, partially in section of a panel raising piston.
Figure 18:
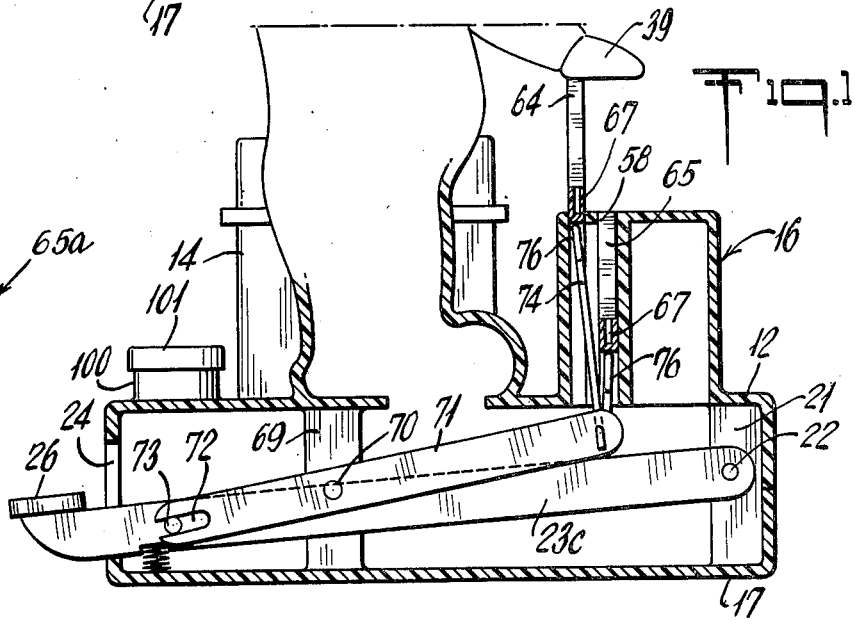
FIG. 18 is a sectional view taken along line 18—18 in FIG. 3 but showing another display panel in raised position.
Figure 24:
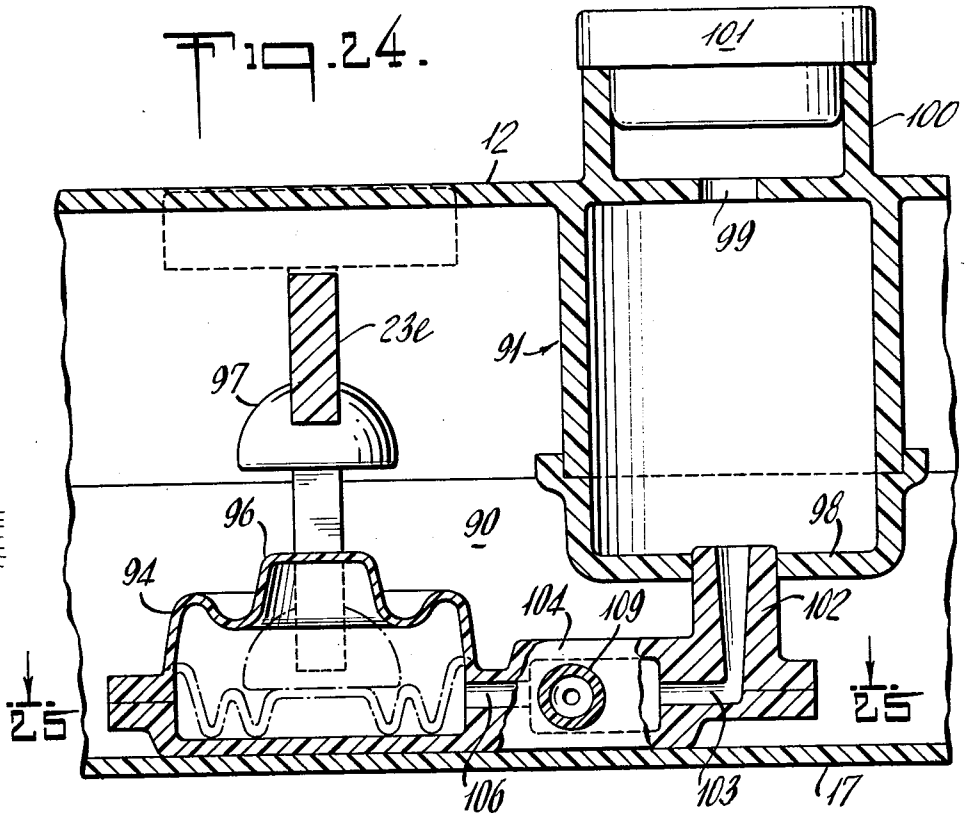
FIG. 24 is a sectional view taken along line 24—24 in FIG. 4.
Figure 25:
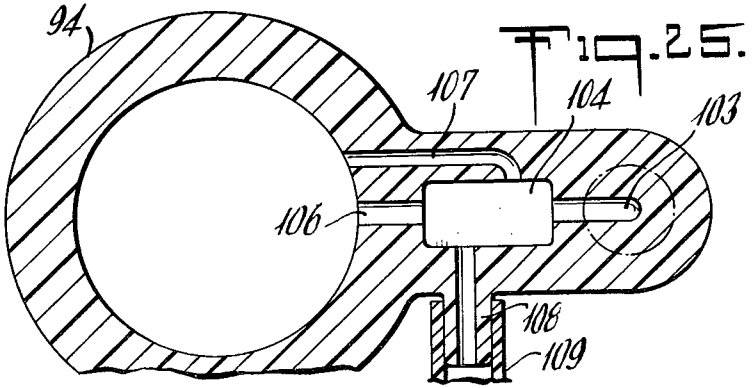
FIG. 25 is a sectional view taken along line 25—25 in FIG. 24.
Figure 23:
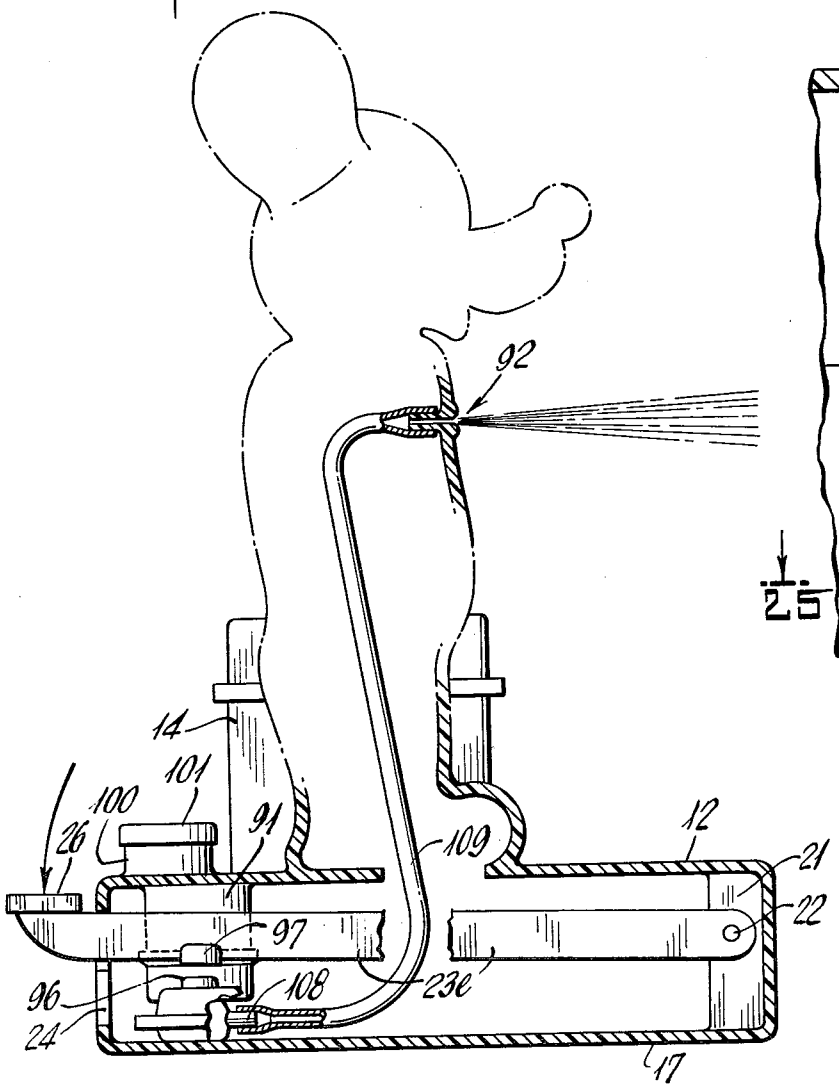
FIG. 23 is a sectional view taken along line 23—23 in FIG. 3.
Figure 26:
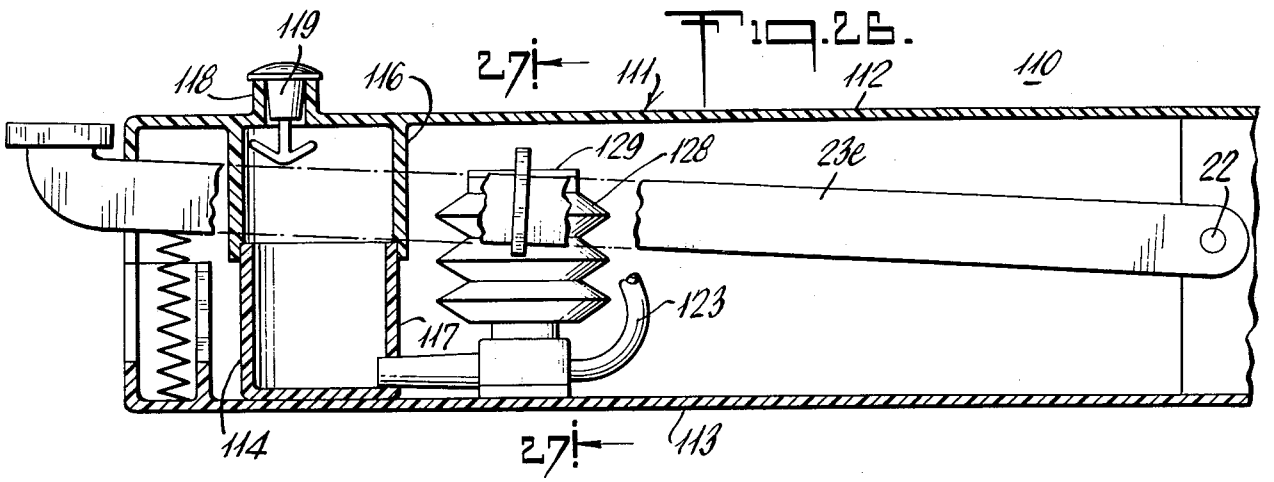
FIG. 26 is a partial view similar to FIG. 23 illustrating a modified pump structure.
Figure 27:
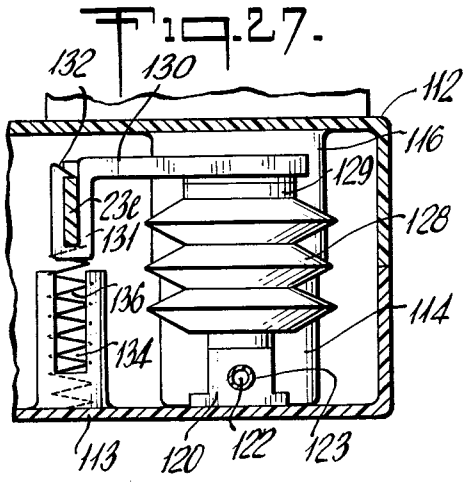
FIG. 27 is a sectional view taken along line 27—27 in FIG. 26.

Affixed to and rockable with the outer end of shaft 32 is a first or right arm 36 whose upper portion 37 is forwardly downwardly inclined and is provided with an upper inside face slidably engaging the outside face of a respective plate 28. The lower portion 38 of right arm 36 extends inwardly forwardly and downwardly and terminates in a medially located downwardly facing hand portion 39 which is at about waist level when figure arm 36 is in its normal depressed position. Embedded in or nested in a well in the underface of hand portion 39 is a cylindrical permanent magnet 40 preferably of the high strength ceramic type. The magnet attracts a metal bar secured in a fold of cloth 39*a* as seen in FIG. 16.

A linearly extending second or left figure arm 41 is affixed to the outer end of and is rockable with shaft 33 and in the normal unactuated condition of the arm 41, the arm depends substantially vertically from shaft 33. An elongated cylindrical cavity 42 is formed in arm 41 and extends from the proximity of shaft 33 to a point short of the free end of arm 41 and communicates with the free end by a coaxial bore 43 of reduced diameter. A second cavity 44 is formed at the inner end of arm 41 transversely offset from and communicating at its inner end with the inner end of cavity 42, the cavities being separated by a partition wall 46. A wand defining rod 47 slidably engages the bore 43 and terminates in a circular head 48 at its inner end which slidably engages the cavity 42. A U-shaped leaf spring 49 nest in cavity 44 and includes an elongated side arm 50 terminating in a boss or protuberance 51 which projects transversely into cavity 42. When the wand 47 is in its fully retracted position telescoping bore 43 and cavity 42, as shown in FIG. 13, the head 48 is disposed inwardly of spring protuberance 51 to releasably lock the wand 47 in its retracted position. The wand 47 may be extended to its fully projected position, as shown in FIG. 14, merely by withdrawing the wand 47, the head 48 springing the protuberance 51 out of the path of the head 48 as it moves outwardly into abutment with the outer shoulder delineating cavity 42 from bore 43. Pressing the wand 47 inwardly returns it to its releasably locked retracted position.

An elongated vertically extending connecting rod 52 couples the shaft 32 to lever 23*a* and terminates at its upper end in a short perpendicular leg 53 which engages the horizontal bore in crank arm 34 on shaft 32 and terminates at its bottom end in an outward laterally stepped portion including a horizontal leg 54 which engages a hole in lever 23*a* intermediate its ends. The connecting rod 52 is so dimensioned that when the figure arm 36 is in its gravity biased lowered position, the lever 23*a* is in its fully spring assisted raised position and depression of lever 23*a* by a key 26 raises the arm 36. A connecting rod 56 similar in shape to rod 52 has a leg at its upper end engaging the bore in crank arm 34 on shaft 33 and a leg at its lower and engaging an intermediate hole in lever 23*a* so that gravity lowered figure arm 41 is swung upwardly by depression of lever 23*d* by means of a respective key 26.

The table box 16 is open at its bottom and includes a rectangular top wall 57 and depending front rear and side skirt walls 60 which are integral with base top wall 12. Formed in box top wall 57 along the rear border thereof are a pair of spaced parallel transversely extending slots 58, the rear slot being adjacent to the box rear wall 60 and a transverse vertical partition wall 59 depends from the front edge of front slot 58 and delineates with the box rear wall a vertical passage 66. Also formed in the box top wall 57 forward of slots 58 is a forwardly convex concentric semicircular coupling opening 61.

A pair of spaced parallel front and rear vertical display panels 64 and 65 are normally vertically slidably housed in the passageway 66, the upper borders of the display panels engaging the slots 58 when the panels are in their lowered passageway housed positions. The rear panel 65 engages the box rear wall 60 and the front panel 64 engages partition wall 59. Each of the panels 64 and 65 is of rectangular configuration and carries any desired representation viewable from its front and has formed at its bottom a depending medial coupling section 67. Replaceable decals may be removably secured to the panels 64, 65 to vary the pictures shown thereon. Underlying each of the panels 64 and 65 is a thin rectangular piston member 65*a* of the width and thickness of a panel 64 or 65 and having in its top face a rectangular coupling recess 67*a* releasably engaging a respective coupling section 67. Formed in the lower border of each piston member 65*a* is a medial arcuate coupling recess 68 having a restricted bottom opening.

Located in the base 11 between levers 23*b* and 23*c* and between base rear wall 19 and FIG. 13 is a pair of vertically slotted vertical posts 69 which are joined to the base top and bottom walls 12 and 17, each of the posts 69 carrying a medially located horizontal transverse pivot pin 70 crossing the respective post slot. A lever 71 extends through the slot in each post 69 and is supported between its ends by a respective pivot pin 70 for swinging about a horizontal transverse axis. A horizontal slot 72 is formed in the rear end of each lever 71 and slidably engages a pin 73 located on a respective lever 23*b*, 23*c* proximate its rear end. The forward ends of levers 71 are disposed below passageway 66 and are coupled by corresponding links 74 to a respective piston member 65*a*. Each of the links 74 terminates at its top in loop section 76 which enters passageway 66 and rockably engages a respective piston member coupling recess 68 and terminates at its bottom in a perpendicular leg 77 which engages a hole in the front end of a respective lever 71. The links 71 and levers 23 and 71 are so related and dimensioned that when a respective lever 23 is released, a corresponding panel 64 and 65 is gravity lowered to follow the lowered piston member 65*a* and the corresponding levers 23*b*, 23*c* is spring raised. When the panel is in its fully housed position, the corresponding lever 23 is fully raised and when such lever is fully depressed the corresponding panel is fully raised by way of a lever 71, link 74 and piston member 65*a*.

A receptacle 78 having a top access opening is separably coupled to the box top wall 57 and includes a circular bottom wall 79, a larger circular top wall 80 having a transversely extending slot shaped opening 81 in its rear and a cylindrical peripheral wall 81*a* extending between the edge of bottom wall 79 to the top wall 80 inwardly of the edge thereof and provided in its rear with an opening 82. Concentrically depending from the bottom wall 79 is an arcuately extending forwardly convex coupling projection 61*a* which releasably snap engages the coupling opening 6. Thus by suitably positioning and pressing the receptacle 78 onto the box top wall it may be coupled and uncoupled to the box.

Figures 5, 6, 7, 8, 9, 10, 11, 12:
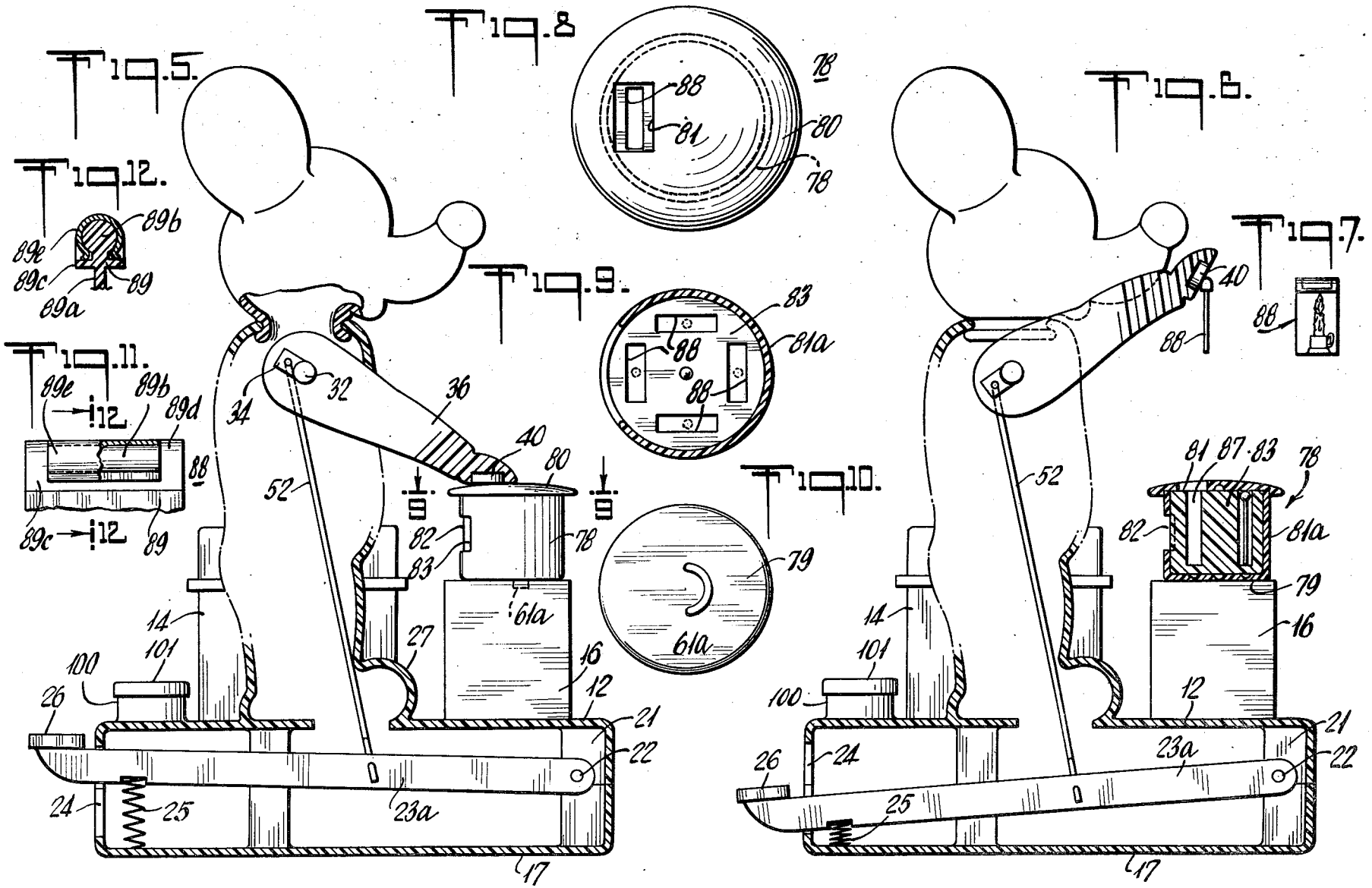
FIG. 5 is a sectional view taken along line 5—5 in FIG. 3.
FIG. 6 is a view similar to FIG. 5 but showing an arm manipulated to a raised position.
FIG. 7 is an elevational view of a magnetically attractable article separably housed in the toy hat section.
FIG. 8 is a top plan view of the hat section of the toy.
FIG. 9 is a sectional view taken along line 9—9 in FIG. 5.
FIG. 10 is a top plan view of the toy table simulating box.
FIG. 11 is an enlarged fragmentary front elevational view of the article of FIG. 7.
FIG. 12 is a sectional view taken along line 12—12 in FIG. 11.

Nesting in the receptacle 78 and rotatable about a vertical axis therein is a coaxial cylindrical block or receiver 83 having a circular bottom face rotatably resting on wall 79 and a cylindrical peripheral face whose rear is exposed and accessible through opening 82 and whose remainder engages the inside face of wall 81*a*. A plurality, for example of four narrow vertical wells 87 are formed and arranged in quadrature in receiver 83 and are selectively rotatable into registry with top opening 81 with the remaining wells being covered by the top wall 80. In normal operation one or any number of the wells 87 vertically slidably contains a picture carrying panel member 88 which is at least partly formed of a magnetic material so that when the magnet 40 in the hand 39 when arm 36 is depressed attracts and lifts the panel 88 from a registering well 87 as the arm 36 is raised. Advantageously, as best seen in FIGS. 7, 11, and 12, each panel member 88 comprises a plastic resin body member 89 including a rectangular plate 89*a* terminating at its top in an enlarged cylindrical bead 89*b* delineated at its bottom by a horizontal cross arm 89*c* which has vertical upright walls 89*d* at opposite ends. An open bottom cylindrical clip member formed of a resilient magnetic metal snap engages the bead 89*b* and is entrapped between walls 89*d*. A panel member 88 slidably nests in each well 87 with the magnetic member 89*e* being substantially at the level of the well top opening.

The third lever 23*e* actuates a pump 90 whose inlet is connected to a water reservoir 91 and whose outlet is connected to a forwardly directed spray nozzle 92 located at the upper front part of the FIG. 13. Specifically the pump 90 comprises a resilient plastic collapsible chamber 94 located in the rear portion of base housing 11 on bottom wall 17 below the rear portion of lever 23*e*, the chamber 94 including a depressable raised top wall defining diaphragm 96 which is resiliently raised to the chamber expanded position and has a raised central portion vertically registering with a flat underfaced button 97 mounted on the bottom of lever 23*e* so that depression of the lever 23*e* effects the contraction of the chamber 94.

The reservoir 91 comprises a cylindrical receptacle depending from the base top wall 12 along-side of the pump 90 and includes a bottom wall 98 having a central opening and located above the base bottom wall and has a filling opening 99 in its top wall which corresponds to wall 12. A neck defining collar 100 coaxial with filler opening 99 is directly upwardly from base top wall 12 and is releasably engaged by a removable closure plug 101 to provide selective access to filler opening 99.

Engaging the opening in bottom wall 98 is a filler tube section 102 which communicates by way of an inlet passage 103, a check valve device 104 of generally known construction and an outlet passage 106 with the interior of chamber 94. The interior of chamber 94 also communicates by way of a passageway 107 and check valve device 104 to a discharge nipple 108 which is engaged by one end of a flexible tube 109, the other end of which engages the inlet to tubular nozzle 92. The check valve device 104 is so constructed and oriented as to permit the flow of water into chamber 94 only from reservoir 91 and from the chamber 94 to nozzle 92. Thus, upon depression of lever 23*e* the diaphragm 96 is depressed to contract chamber 94 and force water through the check valve device 104 and tube 109 out of the nozzle 92 and release of the lever 23*e*, the diaphragm resiliently returns to its raised position to expand chamber 94 which draws water by way of check valve device 104 from reservoir 91.

In the application and operation of the toy 10 described above, with the receptacle 78 uncoupled and removed from box 16, the levers 23*a*, 23*b*, 23*c* and 23*d* may be selectively depressed by means of respective keys 26 either individually or in any desired sequence or combination to raise or lower either one or both of the figure arms 36 and 41, with the wand 47 in its extended or retracted position and to raise or lower either one or both of the display panels 64 and 65 by way of respective pistons 65*a* as earlier explained either by itself or covered by the cloth 39*a* in the well known manner to hide the movement of the panels. Alternatively, the receptacle 78 may be coupled atop the box 16 as aforesaid with each of the wells 87 containing a removable panel 88 having a magnetic member 89*e*. With the arm 36 in its released lowered position, the hand held magnet 40 overlies the opening 81 to attract and retain a panel 88 and upon depression of lever 23*a*, the arm 36 is raised to lift the respective panel 88 out of the well. The panel 88 may be removed from the magnet and the member 83 rotated to bring another well held panel 88 into registry with magnet 40 and the procedure repeated. Depression of the lever 23*e* effects the actuation of the pump and the spraying of water from the nozzle 92.

Referring now to FIGS. 26 to 29 of the drawings which illustrate another embodiment of the present invention, which differs from that first described only in the construction of the pump section and it associated components, all other components being similar in the two embodiments. Specifically, the modified device 110 includes a hollow base member 111 and including a top wall 112 and a bottom wall 113. A reservoir 114 is located in base member 111 and is formed of upper and lower end telescoping walls 116 and 117 extending from top and bottom walls 112 and 113. A filler opening is formed in top wall 112 and communicates with reservoir 114 and is surrounded by an upstanding collar 118 engaged by a separable closure plug 119.

Mounted atop bottom wall 113 proximate reservoir 114 is a fluid coupling block 120 which corresponds to block 104 and includes a tubular nipple having a passageway 121 and projecting into the bottom of reservoir 114, an outlet passageway 122 connected by a flexible tube 123 to the figure spray nozzle and a vertical passageway 126 surrounded by a coaxial coupling collar 127 having a coaxial annular well. A resiliently self expanding flexible bellows 128 formed of polyethylene, polypropylene or the like is vertically disposed and is closed and reinforced at its top 129 and is provided at its bottom with an integrally formed depending coaxial sleeve 135 which is bonded in the annular well in collar 127. The passageways 121, 122 and 126 interconnect, and, if desired, may be provided with check valves as earlier described.

A pump actuating arm 130 extends transversely from the lever 23*e* to a position superimposed atop the bellows top 129 and terminates at its inner end in a depending U-shaped section 131 which engages and clamps to the lever 23*e*, the free end of the outer leg of section 131 being hook shaped, as at 132, to engage the upper edge of lever 23*e*. Underlying and in vertical alignment with U-shaped section 131 and mounted on bottom wall 113 is a vertical open topped sleeve 133, having formed therein longitudinally diametrically opposed vertical slots 134 of widths between the thickness of lever 23*e* and the width of U-shaped section 131. A helical compression spring 136 is housed in sleeve 133 and is entrapped between the bottom of U-shaped section 131 and the bottom of sleve 133, the U-shaped section 131 slidably registering with the bore of sleeve 133 and the lever 23*e* slidably engaging slots 134.

The operation of the embodiment last described is similar to that first described. With the depression of lever 23*e* the bellows 128 is contracted by actuating arm 130 and concurrently therewith, the spring 136 is compressed by U-shaped section 131. The contraction of bellows 128 urges liquid through passageway 122 to the squirt nozzle. Upon release of the lever 23*e*, spring 136 raises arm 130 and lever 23*e* and bellows 128 expands to draw liquid from reservoir 114.

Figure 30:
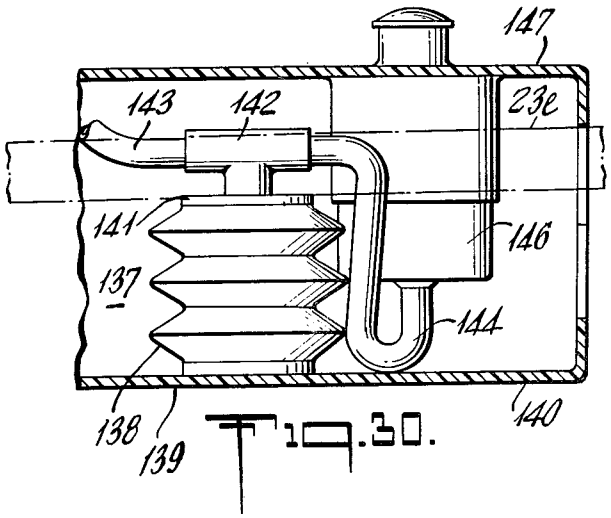
FIG. 30 is a front elevational view of a modified pump section.
Figure 29:
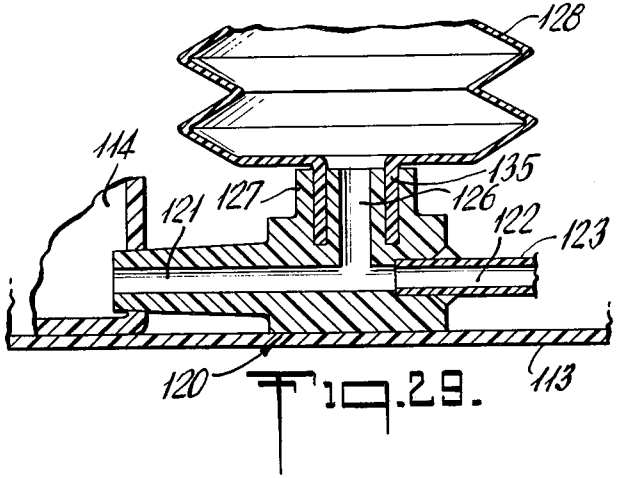
FIG. 29 is an enlarged partial detail view of the pump of FIG. 26.
Figure 28:
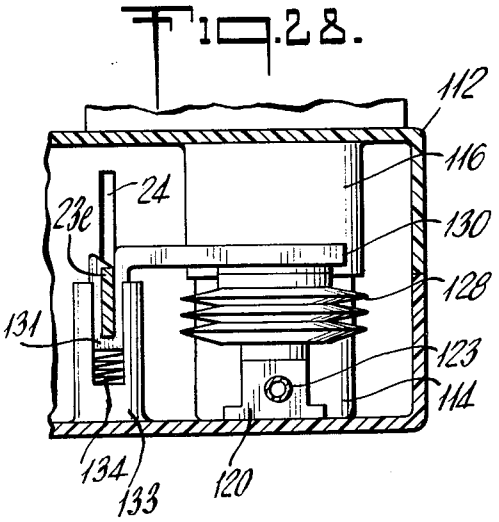
FIG. 28 is a view similar to FIG. 27 showing the pump in compressed condition.

A modified pump structure 137 which may be employed in the devices described above is shown in FIG. 30. The structure 137 includes a resiliently self-expanding closed bottom bellows 138 of the nature earlier described vertically mounted atop the bottom wall 139 of the figure supporting hollow base 140. The top of bellows 138 is closed by a reinforcing wall 141 which supports a tubular T-coupling 142 including a vertical leg communicating with the interior of accordian bellows 138 and a horizontal leg whose opposite ends are connected respectively by way of a first flexible tube 143 to the figure squirt or spray nozzle and by a second flexible tube 144 to the bottom of a refillable liquid reservoir 146 depending from the hollow base top wall 147. As in the earlier embodiments, the bellows 138 may be compressed and contracted by depression of the lever 23*e* and expands with the release of the lever to respectively urge water through the squirt nozzle and draw water from the reservoir 146. If desired, suitable properly oriented check valves may be provided.

While there have been described and illustrate preferred embodiments of the present invention, it is apparent that numerous alterations omissions and additions may be made without departing from the spirit thereof.

I claim:

1. An animated toy device comprising an animal figure simulating upright body member including a first arm member supported proximate its inner end for swinging between a raised position and a lowered forwardly downwardly extending position, manually operable first actuating means for swinging said arm member between its raised and lowered positions, a permanent magnet carried by said arm member proximate its outer end, an article at least partially formed of a magnetic material and means for removably supporting said article proximate said magnet when said arm is in its lowered position.

2. The animated toy device of claim 1 comprising a hollow base, said body member being mounted on said base, said actuating means comprising a lever swingably supported at its inner end within said base member and projecting outside said base member and means coupling said lever to said arm member whereby swinging of said lever effects the swinging of said arm member.

3. The animated toy device of claim 2 wherein said body member is hollow and communicates with said base member and including a transverse first shaft journalled in the upper part of said body member and connected at its outer end to said first arm member and provided with said body member with a crank arm, said coupling means comprising a first connecting rod extending between said lever and said crank arm.

4. The animated toy device of claim 3 comprising a second shaft journalled into said body member opposite said first shaft and having a second crank arm within said body member, a second arm member affixed to the outer end of said second shaft, a second hand manipulated lever pivoted in said base member and projecting externally thereof and a second connecting rod coupling said second lever and second crank arm.

5. The animated toy device of claim 4 wherein said second arm member has a longitudinal cavity extending to the outer end of said cavity and comprising a wand member telescoping said cavity and movable therein between an extended and a retracted position.

6. The animated toy device of claim 4 comprising a housing located atop and communicating with said base member and disposed forwardly of said body member and having an opening in the top thereof, a display member disposed in said housing and being movable through said top opening therein, a third lever swingably pivoted in said base member and projecting outwardly thereof and actuating means coupling said third lever to said display member to raise and lower said display member with the swinging of said third lever.

7. The animated toy device of claim 6 including a plurality of said display member disposed in said housing and individually movable between raised and lowered positions, a plurality of said third levers and said actuating means comprises means coupling each of said third levers to respective display members.

8. The animated toy device of claim 6 including a receptacle separably mounted atop said housing and having an access opening in the top thereof in registry with said magnet when said first arm is in its lowered position, said magnetic article being disposed in said receptacle and removable through said access opening.

9. The animated toy device of claim 8 wherein said receptacle comprises an outer shell including a top wall having said access opening and an open topped holder member having a plurality of spaced compartments disposed in said shell and movable to bring selected compartments into registry with said access opening one of said article being removably locatable in each of said compartments.

10. The animated toy device of claim 9 wherein said levers are parallel and extend from said base member through the rear thereof and including a finger operable key mounted on the rear end of each of said levers.

11. The animated toy device of claim 3 comprising a positive displacement pump located in said base member, means for actuating said pump including a fourth lever located in said base member and projecting externally thereof and drive associated with said pump, said pump including inlets and outlets, a liquid reservoir connected to said pump inlet, a discharge nozzle located on said body member and lumen means connecting said nozzle to said pump outlet.

12. The animated toy device of claim 11 wherein said pump includes a contractable expandable pumping chamber provided with an upwardly facing resilient diaphragm, said diaphragm being depressed by said fourth lever with the downward swinging thereof.

13. The animated toy device of claim 11 wherein said pump includes an expandable contractable accordian bellows whichis contracted by the depression of said fourth lever with the downward swinging thereof.

* * * * *